US010176916B2

(12) United States Patent
Seko et al.

(10) Patent No.: US 10,176,916 B2
(45) Date of Patent: Jan. 8, 2019

(54) ELECTRONIC COMPONENT

(71) Applicant: MURATA MANUFACTURING CO., LTD., Kyoto (JP)

(72) Inventors: Atsushi Seko, Nagaokakyo (JP); Katsuhiro Misaki, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 13/743,221

(22) Filed: Jan. 16, 2013

(65) Prior Publication Data

US 2013/0187744 A1 Jul. 25, 2013

(30) Foreign Application Priority Data

Jan. 24, 2012 (JP) ..... 2012-012103

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 17/00*** | (2006.01) |

(52) U.S. Cl.

CPC ..... *H01F 17/0013* (2013.01); *H01F 27/292* (2013.01)

(58) Field of Classification Search

CPC ..... H01F 17/0013; H01F 17/292; H01F 2017/002; H01F 2017/004; H01F 27/2804; H01F 2027/2809; H01F 5/003

USPC ..... 336/200, 223, 234, 232

See application file for complete search history.

(56) References Cited

U.S. PATENT DOCUMENTS

| | | | | |
|---|---|---|---|---|
| 7,071,805 | B2 * | 7/2006 | Hasegawa et al. | 336/200 |
| 7,378,931 | B2 * | 5/2008 | Odahara et al. | 336/200 |
| 7,694,414 | B2 * | 4/2010 | Maeda | H01F 17/0013 29/605 |
| 8,201,318 | B2 | 6/2012 | Yamano | |
| 8,237,533 | B2 * | 8/2012 | Chatzopoulos et al. | 336/200 |
| 2007/0296536 | A1 * | 12/2007 | Odahara | H01F 17/0013 336/200 |
| 2007/0296538 | A1 * | 12/2007 | Maeda et al. | 336/232 |

(Continued)

FOREIGN PATENT DOCUMENTS

| | | | |
|---|---|---|---|
| CN | 101142641 | A | 3/2008 |
| CN | 101283417 | A | 10/2008 |

(Continued)

OTHER PUBLICATIONS

An Office Action; "Notice of Preliminary Rejection," issued by the Korean Intellectual Property Office dated Jan. 9, 2014, which corresponds to Korean Patent Application No. 10-2013-8058 and is related to U.S. Appl. No. 13/743,221.

*Primary Examiner* — Mang Tin Bik Lian

(74) *Attorney, Agent, or Firm* — Studebaker & Brackett PC

(57) ABSTRACT

A multilayer body is formed of a plurality of insulator layers that are stacked on top of one another. A coil is a helical coil provided in the multilayer body and includes a plurality of coil conductor layers that are superposed with one another so as to form a ring-shaped path when seen in plan view from a stacking direction and a plurality of via hole conductors that connect the plurality of coil conductor layers together. The path includes corners that project outward and corners that project inward. Each of the via hole conductors are provided at one of the corners, which project outward.

18 Claims, 7 Drawing Sheets

(56) References Cited

U.S. PATENT DOCUMENTS

| | | | | |
|---|---|---|---|---|
| 2008/0257488 | A1 | 10/2008 | Yamano | |
| 2009/0153282 | A1* | 6/2009 | Taoka et al. | 336/200 |
| 2010/0328009 | A1* | 12/2010 | Tawa | H01F 17/0013 336/200 |
| 2012/0049974 | A1* | 3/2012 | Masuda | H01P 5/187 333/116 |

FOREIGN PATENT DOCUMENTS

| | | | |
|---|---|---|---|
| JP | 11-224817 | A | 8/1999 |
| JP | 2004-071962 | A | 3/2004 |
| JP | 2006-114552 | A | 4/2006 |
| JP | 2007-134555 | A | 5/2007 |
| JP | 2010-165975 | A | 7/2010 |
| KR | 2007-0096037 | A | 10/2007 |
| WO | 2007/080680 | A1 | 7/2007 |

* cited by examiner

ELECTRONIC COMPONENT

CROSS REFERENCE TO RELATED APPLICATIONS

The present application claims priority to Japanese Patent Application No. 2012-012103 filed on Jan. 24, 2012, the entire contents of this application being incorporated herein by reference in their entirety.

TECHNICAL FIELD

The technical field relates to electronic components, and more particularly, to an electronic component that includes a multilayer body having a coil built in the multilayer body.

BACKGROUND

As an example of a known electronic component, Japanese Unexamined Patent Application Publication No. 2010-165975 (hereinafter referred to as "Patent Document 1") describes a multilayer inductor. FIG. 7 is an exploded perspective view of a multilayer body 500 of the multilayer inductor described in Patent Document 1.

The multilayer body 500 of the multilayer inductor described in Patent Document 1 includes a plurality of insulator layers 502 having a rectangular shape that are stacked on top of one another. Outer electrode patterns 506 having an L-shape are provided at corners of the insulator layers 502. The plurality of outer electrode patterns 506 are superposed with one another so as to form outer electrodes. Coil conductor patterns 504 having a partially cut-away ring shape are formed on the respective insulator layers 502. The coil conductor patterns 504 are shaped so as to follow the shapes of the outer electrode patterns 506 in such a manner as to avoid making contact with the outer electrode patterns 506. The plurality of coil conductor patterns 504 are connected together through via hole conductors 505 so as to form a coil.

SUMMARY

The present disclosure provides an electronic component capable of having a large inner diameter of a coil.

An electronic component according to an embodiment of the present disclosure includes a multilayer body and a coil that is a helical coil provided in the multilayer body and that includes a plurality of coil conductor layers that are superposed with one another so as to form a ring-shaped path when seen in plan view from a stacking direction and a plurality of via hole conductors that connect the plurality of coil conductor layers together. The ring-shaped path includes a plurality of first corners that project outward of the ring-shaped path and a plurality of second corners that project inward of the ring-shaped path. All of the via hole conductors are provided at the respective first corners.

DETAILED DESCRIPTION

The inventors realized that the multilayer inductor described in Patent Document 1 has a problem that an inner diameter of the coil is small due to the presence of the via hole conductors 505. It is preferable that the via hole conductors 505 be made as large as possible in view of reducing direct-current resistance of the coil and in view of improving connectivity between each via hole conductor 505 and the corresponding coil conductor patterns 504. However, if each of the via hole conductors 505 is made large, portions of the corresponding coil conductor patterns 504 to which the via hole conductor 505 is connected also needs to be made large in order to prevent deterioration of the connectivity due to misregistration or the like. Here, in the multilayer inductor described in Patent Document 1, each of the via hole conductors 505 is connected to linear portions of the corresponding coil conductor patterns 504. Therefore, if the widths of the portions of the coil conductor patterns 504 to which the via hole conductor 505 are connected is made large, the portions will project into an inner side of the coil. As a result, the inner diameter of the coil will become small.

An electronic component that can address the above shortcomings will now be described.

Figure 1:
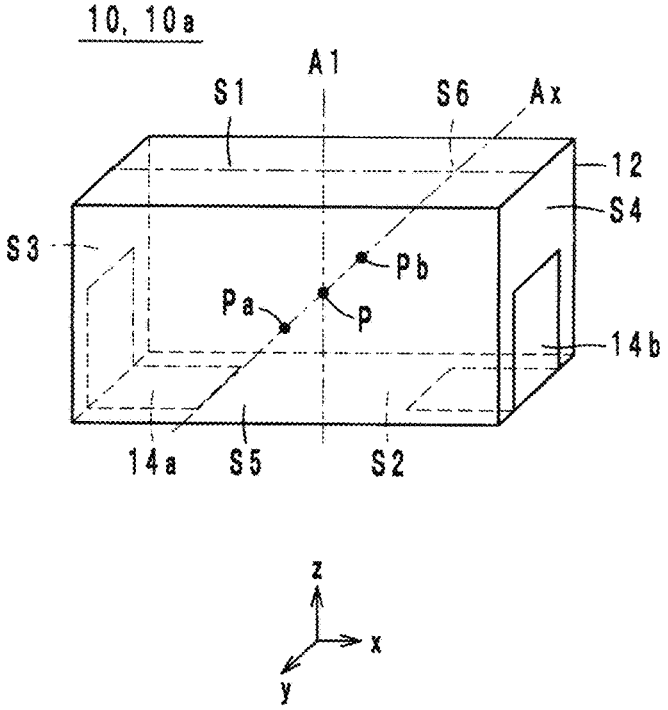
FIG. 1 is an external perspective view of an electronic component according to an exemplary embodiment.
Figure 2:
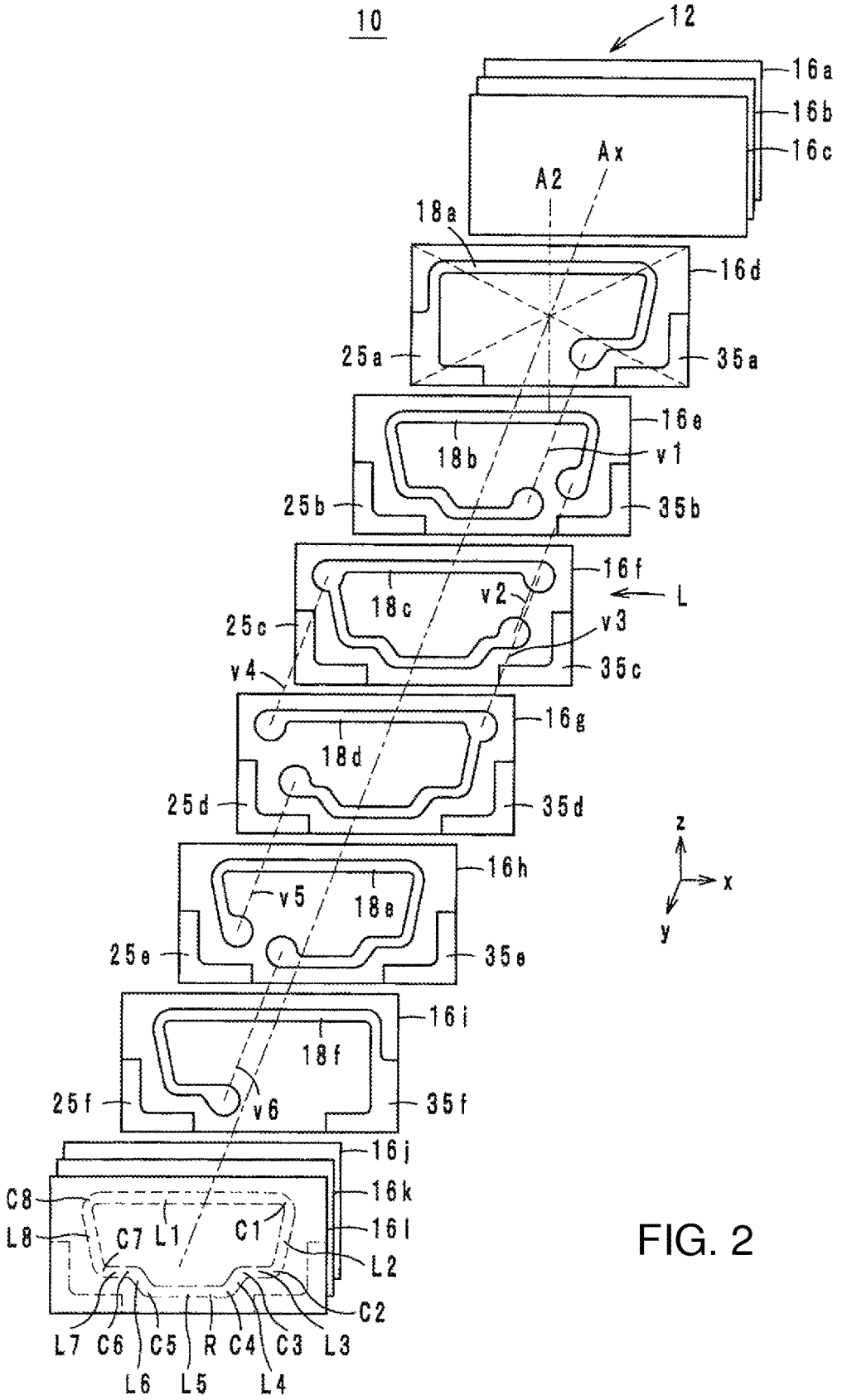
FIG. 2 is an exploded perspective view of the electronic component shown in FIG. 1.

An electronic component according to an exemplary embodiment will now be described with reference to the accompanying drawings. FIG. 1 is an external perspective view of an electronic component 10 according to the embodiment. FIG. 2 is an exploded perspective view of the electronic component 10 shown in FIG. 1. A stacking direction of the electronic component 10 is hereinafter defined as the y-axis direction. In addition, when seen in plan view from the y-axis direction, a direction in which long sides of the electronic component 10 extend is defined as the x-axis direction, and a direction in which short sides of the electronic component 10 extend is defined as the z-axis direction.

As shown in FIGS. 1 and 2, the electronic component 10 includes a multilayer body 12, outer electrodes 14 (14*a* and 14*b*), and a coil L (not shown in FIG. 1).

As shown in FIG. 2, the multilayer body 12 is formed of a plurality of insulator layers 16*a* to 16*l*, which are sometimes collectively referred to herein as insulator layers 16, that are stacked on top of one another so as to be arranged in this order from the negative side to the positive side of the y-axis direction, and the multilayer body 12 has a rectangular parallelepiped shape. The multilayer body 12 thus has a top surface S1, a bottom surface S2, end surfaces S3 and S4, and side surfaces S5 and S6. The top surface S1 is a surface of the multilayer body 12 on the positive side of the z-axis direction. The bottom surface S2 is a surface of the multilayer body 12 on the negative side of the z-axis direction and is also a mounting surface that faces a circuit board when the electronic component 10 is mounted on the circuit board. Long sides (i.e., outer edges) of the insulator layers 16 on the positive side of the z-axis direction and long sides (i.e., outer edges) of the insulator layers 16 on the negative side of the z-axis direction, respectively, are arranged in a row so as to form the top surface S1 and the bottom surface S2. The end surfaces S3 and S4 are surfaces of the multilayer body 12 on the negative and the positive sides of the x-axis direction, respectively. Short sides (i.e., outer edges) of the insulator layers 16 on the negative side of the x-axis direction and short sides (i.e., outer edges) of the insulator layers 16 on the positive side of the x-axis direction, respectively, are arranged in a row so as to form the end surfaces S3 and S4. In addition, the end surfaces S3 and S4 are adjacent to the bottom surface S2. The side surfaces S5 and S6 are surfaces of the multilayer body 12 on the positive and the negative sides of the y-axis direction, respectively. It is to be understood that designations of orientation used herein (e.g., "top," "bottom," "front," "back," and "x-," "y-," and "z-axis" directions) are made for the convenience of explaining the embodiments shown in the figures, and that other orientations can be arbitrarily defined.

As shown in FIG. 2, the insulator layers 16 each have a rectangular shape and are made of, for example, an insulating material mainly composed of borosilicate glass. Surfaces of the insulator layers 16 on the positive side of the y-axis direction and surfaces of the insulator layers 16 on the negative side of the y-axis direction are hereinafter referred to as front surfaces and rear surfaces, respectively.

The coil L includes coil conductor layers 18*a* to 18*f*, which are sometimes collectively referred to herein as coil conductors 18, and via hole conductors v1 to v6. When seen in plan view from the positive side of the y-axis direction, the coil L has a helical shape that winds clockwise from the negative side of the y-axis direction to the positive side of the y-axis direction. The coil conductor layers 18*a* to 18*f* are provided on the insulator layers 16*d* to 16*i*, respectively, and when seen in plan view from the y-axis direction, the coil conductor layers 18*a* to 18*f* are superposed with one another so as to form a ring-shaped path R. Details of the path R will be described later. Each of the coil conductor layers 18*a* to 18*f* has a shape of the path R which is partially cut-away. The coil conductor layers 18 are made of a conductive material, for example, a conductive material mainly composed of Ag. Ends on upstream sides and ends on downstream sides of the coil conductor layers 18 in a clockwise direction are hereinafter referred to as upstream ends and downstream ends, respectively.

Each of the via hole conductors v1 to v6 extends through one of the insulator layers 16*e* to 16*i* in the y-axis direction. The via hole conductors v1 to v6 are made of, for example, a conductive material mainly composed of Ag. When seen in plan view from the y-axis direction, the via hole conductors v1 to v6 are provided at different positions on the ring-shaped path R and divide the ring-shaped path R into six sections.

The via hole conductor v1 connects a downstream end of the coil conductor layer 18*a* with an upstream end of the coil conductor layer 18*b*. The via hole conductor v2 connects a downstream end of the coil conductor layer 18*b* with an upstream end of the coil conductor layer 18*c*. The via hole conductor v3 connects a downstream end of the coil conductor layer 18*c* with the coil conductor layer 18*d*. The via hole conductor v4 connects the coil conductor layer 18*c* with an upstream end of the coil conductor layer 18*d*. The via hole conductor v5 connects a downstream end of the coil conductor layer 18*d* with an upstream end of the coil conductor layer 18*e*. The via hole conductor v6 connects a downstream end of the coil conductor layer 18*e* with an upstream end of the coil conductor layer 18*f*.

The via hole conductors v1 to v6 are connected to the coil conductor layers 18*a* to 18*f* as described above, so that the coil conductor layers 18*a* and 18*f* each have a length of four sections, and the coil conductor layers 18*b* to 18*e* each have a length of five sections.

As shown in FIG. 1, the outer electrode 14*a* is built in the bottom surface S2 and the end surface S3 of the multilayer body 12, which are formed of the outer edges of the insulator layers 16*a* to 16*l* that are arranged in a row, and the outer electrode 14*a* is provided at a corner where the bottom surface S2 and the end surface S3 intersect. That is, the outer electrode 14*a* has an L-shape when seen in plan view from the y-axis direction and is provided outside of the path R. The outer electrode 14*a* is formed of external conductive layers 25*a* to 25*f*, which are sometimes collectively referred to herein as external conductive layers 25 that are stacked on top of one another as shown in FIG. 2.

As shown in FIG. 2, the external conductive layers 25 (25*a* to 25*f*) extend through the insulator layers 16*d* to 16*i* in the y-axis direction and are stacked on top of one another so as to be electrically connected to one another. The external conductive layers 25*a* to 25*f* have an L-shape and are provided at respective corners where the short sides of the insulator layers 16*d* to 16*i* on the negative side of the x-axis direction and the long sides of the insulator layers 16*d* to 16*i* on the negative side of the z-axis direction intersect when seen in plan view from the y-axis direction. The external conductive layer 25*a* is connected to an upstream end of the coil conductor layer 18*a*.

As shown in FIG. 1, the outer electrode 14*b* is built in the bottom surface S2 and the end surface S4 of the multilayer body 12, which are formed of the outer edges of the insulator layers 16*a* to 16*l* that are arranged in a row, and the outer electrode 14*b* is provided at a corner where the bottom surface S2 and the end surface S4 intersect. That is, the outer electrode 14*b* has an L-shape when seen in plan view from the y-axis direction and is provided outside of the path R. The outer electrode 14*b* is formed of external conductive layers 35 (35*a* to 35*f*) that are stacked on top of one another as shown in FIG. 2.

As shown in FIG. 2, the external conductive layers 35*a* to 35*f*, which are sometimes collectively referred to herein as external conductive layers 35, extend through the insulator layers 16*d* to 16*i* in the y-axis direction and are stacked on top of one another so as to be electrically connected to one another. The external conductive layers 35*a* to 35*f* have an L-shape and are provided at respective corners where the short sides of the insulator layers 16*d* to 16*i* on the positive side of the x-axis direction and the long sides of the insulator layers 16*d* to 16*i* on the negative side of the z-axis direction intersect when seen in plan view from the y-axis direction. The external conductive layer 35*f* is connected to a downstream end of the coil conductor layer 18*f*.

Portions of the outer electrodes 14*a* and 14*b* that are exposed on the outside of the multilayer body 12 can be tin-plated and nickel-plated in order to obtain a good solder connection when being mounted. The insulator layers 16*a* to 16*c* are stacked on one side of the outer electrodes 14*a* and 14*b*, and the insulator layers 16*j* to 16*l* are stacked on the other side of the outer electrodes 14*a* and 14*b* in the y-axis direction. Therefore, the outer electrodes 14*a* and 14*b* are not exposed on the side surfaces S5 and S6.

The electronic component 10 has a configuration capable of having a large inner diameter of the coil L. The configuration will be described below.

As shown in FIG. 2, the path R is formed of straight lines L1 to L8 and has a substantially rectangular shape. The straight lines L1, L2, L5, and L8 extend along respective four sides of each insulator layer 16. The term "along" includes not only a state of being parallel but also a state of being slightly inclined from the parallel state. The straight line L3 is connected to an end of the straight line L2 on the negative side of the z-axis direction and is bent with respect to the straight line L2 toward the negative side of the x-axis direction (i.e., toward inside of the path R). The straight line L4 is connected to an end of the straight line L5 on the positive side of the x-axis direction and is bent with respect to the straight line L5 toward the positive side of the z-axis direction (i.e., toward inside of the path R). The straight line L6 is connected to an end of the straight line L5 on the negative side of the x-axis direction and is bent with respect to the straight line L5 toward the positive side of the z-axis direction (i.e., toward inside of the path R). The straight line L7 is connected to an end of the straight line L8 on the negative side of the z-axis direction and is bent with respect to the straight line L8 toward the positive side of the x-axis direction (i.e., toward inside of the path R).

Since the straight lines L1 to L8 are structured as described above, the path R includes corners C1, C2, C4, C5, C7, and C8 that project outward of the path R and corners C3 and C6 that project inward of the path R. More specifically, the straight lines L1 and L2 are connected to each other, so that the corner C1 that projects toward the outside of the path R is formed. The straight lines L2 and L3 are connected to each other, so that the corner C2 that projects toward the outside of the path R is formed. The straight lines L3 and L4 are connected to each other, so that the corner C3 that projects toward the inside of the path R is formed. The straight lines L4 and L5 are connected to each other, so that the corner C4 that projects toward the outside of the path R is formed. The straight lines L5 and L6 are connected to each other, so that the corner C5 that projects toward the outside of the path R is formed. The straight lines L6 and L7 are connected to each other, so that the corner C6 that projects toward the inside of the path R is formed. The straight lines L7 and L8 are connected to each other, so that the corner C7 that projects toward the outside of the path R is formed. The straight lines L8 and L9 are connected to each other, so that the corner C8 that projects toward the outside of the path R is formed. As described above, the corners C3 and C6, which project toward the inside of the path R, are provided at corners of the path R that correspond to the corners of the insulator layers 16 at which the external conductive layers 25 and 35 are provided.

The path R having the above configuration avoids the external conductive layers 25 and 35 at the corners C3 and C6. That is, a portion of the path R that faces the external conductive layers 25 and a portion of the path R that faces the external conductive layers 35 have a shape that follows the shape of the external conductive layers 25 and a shape that follows the shape of the external conductive layers 35, respectively. As a result, the path R comes near the external conductive layers 25 and 35 without coming into contact with the external conductive layers 25 and 35. Therefore, an inner diameter of the path R becomes large, and the inner diameter of the coil L becomes large.

Furthermore, each of the via hole conductors v1 to v6 is provided at one of the corners C1, C2, C4, C5, C7, and C8, which project outward, and are not provided at the corners C3 and C6, which project inward. The via hole conductors v1 to v6 are not provided on the straight lines L1 to L8, either. More specifically, the via hole conductor v1 is provided at the corner C4. The via hole conductor v2 is provided at the corner C2. The via hole conductor v3 is provided at the corner C1. The via hole conductor v4 is provided at the corner C8. The via hole conductor v5 is provided at the corner C7. The via hole conductor v6 is provided at the corner C5. Each of the via hole conductors v1 to v6 is provided at one of the corners C1, C2, C4, C5, C7, and C8, which project outward, in this way, and thus, as will be described later, the inner diameter of the path R becomes large, and the inner diameter of the coil L becomes large.

More specifically, it is preferable that the via hole conductors v1 to v6 be made large in view of reducing direct-current resistance of the coil L and in view of improving connectivity between the via hole conductors v1 to v6 and the coil conductor layers 18. If the via hole conductors v1 to v6 are made large as described above, the widths of portions of the coil conductor layers 18 to which the via hole conductors v1 to v6 are connected will be larger than those of the other portions of the coil conductor layers 18.

Here, if any one of the via hole conductors v1 to v6 is provided on one of the straight lines L1 to L8, the widths of a certain portion of the straight lines L1 to L8 will be larger than those of the other portions of the straight lines L1 to L8. As a result, the inner diameter of the path R will become small, and the inner diameter of the coil L will become small.

If each of the via hole conductors v1 to v6 is provided at one of the corners C3 and C6, which project inward, the inner diameter of the path R also will become small as will be described below. More specifically, the corners C3 and C6 are corners that are provided so as to allow the path R to avoid the external conductive layers 25 and 35. The corners C3 and C6 are thus in the vicinity of the external conductive layers 35 and 25, respectively. Therefore, it is difficult to make the widths of the corners C3 and C6 large by making the corners C3 and C6 project toward the outside of the path R in order to provide the via hole conductors v1 to v6 at the corners C3 and C6. Therefore, the widths of the corners C3 and C6 need to be made large by projecting toward the inside of the path R. However, in this case, the inner diameter of the path R becomes small, and the inner diameter of the coil L becomes small.

In the electronic component 10, each of the via hole conductors v1 to v6 is provided at one of the corners C1, C2, C4, C5, C7, and C8, which project outward. The widths of the corners C1, C2, C4, C5, C7, and C8 can thus be made large by making the corners C1, C2, C4, C5, C7, and C8 project toward the outside of the path R. As a result, in the electronic component 10, the inner diameter of the path R becomes large, and the inner diameter of the coil L becomes large.

As will be described below, the electronic component 10 has a configuration in which the electronic component 10 can be mounted in the state shown in FIG. 1 and can also be mounted in a state where it is being rotated 180 degrees about the z axis from the state shown in FIG. 1. More specifically, as shown in FIG. 1, the coil L is identical to a coil that is obtained by rotating the coil L 180 degrees about a straight line A1 that passes a midpoint P of an intersection point Pa of a coil axis Ax of the coil L and the side surface S5 and an intersection point Pb of the coil axis Ax and the side surface S6, and that is perpendicular to the bottom surface S2 (see FIG. 1).

In order to have the above configuration, in the coil L, the coil conductor layer 18*a* that is a first layer and the coil conductor layer 18*f* that is a sixth layer are arranged so as to be line-symmetrical to each other with respect to a straight line A2 that passes an intersection point of diagonal lines of each insulator layer 16 and that is perpendicular to the bottom surface S2. The coil conductor layer 18*b* that is a second layer and the coil conductor layer 18*e* that is a fifth layer are arranged so as to be line-symmetrical to each other with respect to the straight line A2. The coil conductor layer 18*c* that is a third layer and the coil conductor layer 18*d* that is a fourth layer are arranged so as to be line-symmetrical to each other with respect to the straight line A2. Furthermore, the via hole conductor v3 and the via hole conductor v4 are arranged so as to be line-symmetrical to each other with respect to the straight line A2.

The above-described configuration of the coil L may be generalized as follows. The coil L includes n coil conductor layers 18, where n is a natural number of two or more. One of the coil conductor layers 18 that is a $k^{th}$ layer, where k is an integer of zero or more and n or less, and one of the coil conductor layers 18 that is an $n-k+1^{th}$ layer are arranged so as to be line-symmetrical to each other with respect to the straight line A2.

In the electronic component 10 having the above configuration, the coil L has the same configuration in the state shown in FIG. 1 and in the state where it is being rotated 180 degrees about the z axis from the state shown in FIG. 1. Therefore, characteristics of the electronic component 10 will not change if the electronic component 10 is mounted on a circuit board in either state. It is thus not necessary to form a direction identification mark on the top surface S1 of the electronic component 10. Since a direction identification mark will not be formed, there is no need for an area for forming a direction identification mark (which corresponds to the direction recognition mark of the multilayer inductor described in Patent Document 1) in the vicinity of the sides of the insulator layers 16 on the positive side of the z-axis direction. As a result, in the electronic component 10, the inner diameter of the coil L can be made large.

In the electronic component 10, as will be described below, the number of turns of the coil L can be increased. More specifically, the via hole conductors v1 to v6 are provided at six positions on the path R, and the path R is divided into six sections. The coil conductor layers 18 *b* to 18*e* each have a length of five sections. Therefore, the lengths of the coil conductor layers 18*b* to 18*e* each can be maximized. As a result, in the electronic component 10, the number of turns of the coil L will be increased. Note that in the case where the ring-shaped path R is divided into m sections by the via hole conductors, where m is a natural number of two or more, the coil conductor layers 18 may have a length of m−1 sections.

An exemplary method of manufacturing the electronic component 10 according to the present embodiment will now be described with reference to the accompanying drawings. FIGS. 3A, 3B, 4A, 4B, 5A, and 5B are plan views of the electronic component 10 during production.

Figure 3A:
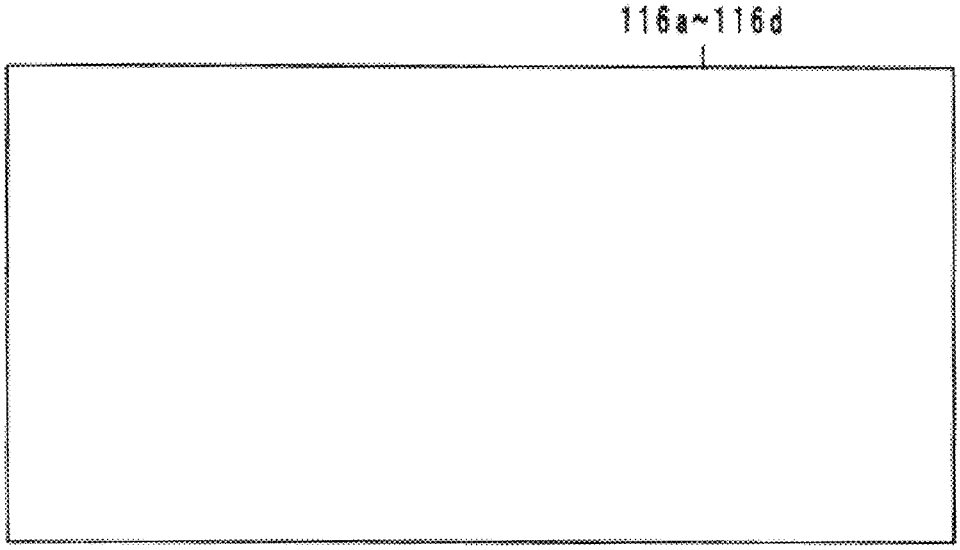
FIGS. 3A and 3B are plan views of the electronic component during production.

First, as shown in FIG. 3A, insulating paste layers 116*a* to 116*d* are formed by repeating application of an insulating paste mainly composed of borosilicate glass by screen printing. The insulating paste layers 116*a* to 116*c* are paste layers that will become the insulator layers 16*a* to 16*c*, which are insulator layers for external layers located outside of the coil L.

Figure 3B:
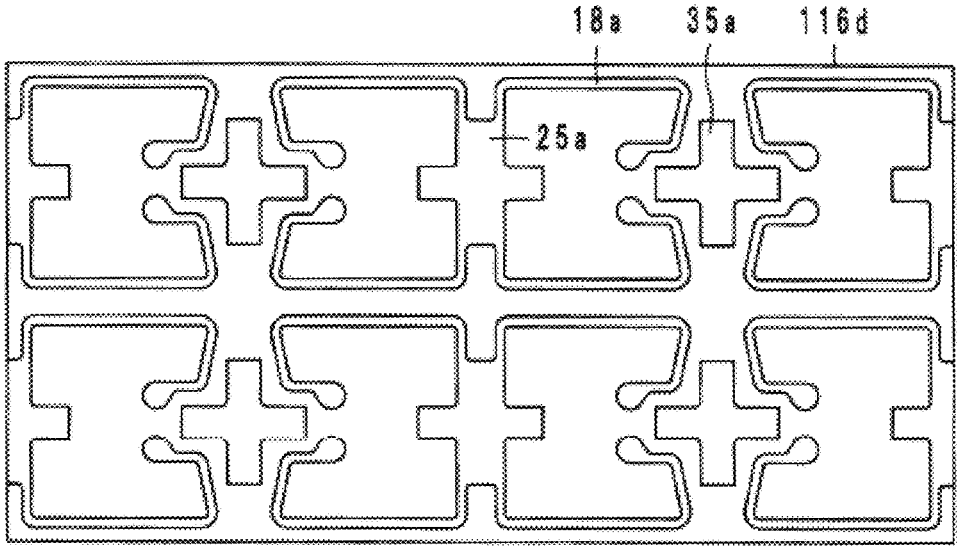

Next, as shown in FIG. 3B, the coil conductor layer 18*a* and the external conductive layers 25*a* and 35*a* are formed through a photolithography process. In particular, a photosensitive conductive paste containing Ag as a main metal is applied by screen printing so as to form a conductive paste layer on the insulating paste layer 116*d*. Furthermore, the conductive paste layer is exposed to ultraviolet rays or the like through a photo-mask and developed by using an alkaline solution or the like. As a result, the external conductive layers 25*a* and 35*a* and the coil conductor layers 18*a* are formed on the insulating paste layer 116*d*.

Figure 4A:
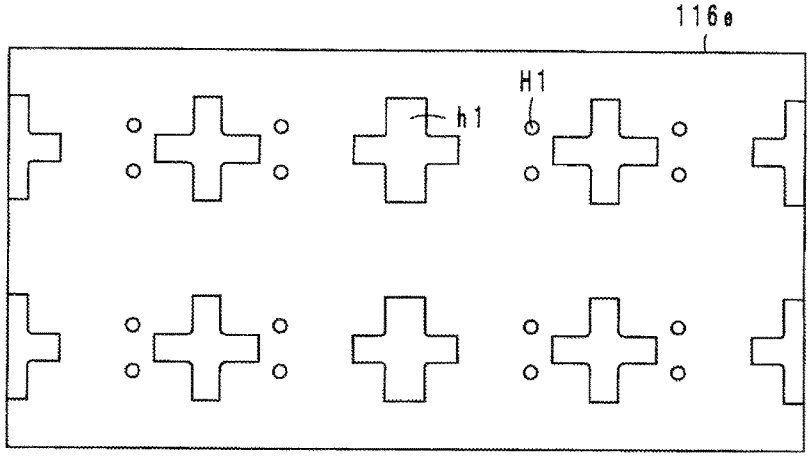
FIGS. 4A and 4B are plan views of the electronic component during production.

Next, as shown in FIG. 4A, an insulating paste layer 116*e* in which openings h1 and via holes H1 are provided is formed through a photolithography process. In particular, a photosensitive insulating paste is applied by screen printing so as to form an insulating paste layer on the insulating paste layer 116*d*. Furthermore, the insulating paste layer is exposed to ultraviolet rays or the like through a photo-mask and developed by using an alkaline solution or the like. The insulating paste layer 116*e* is a paste layer that will become the insulator layer 16*e*. Each of the openings h1 is a hole having a cross shape formed of two external conductive layers 25*b* and two external conductive layers 35*b* connected to one another.

Figure 4B:
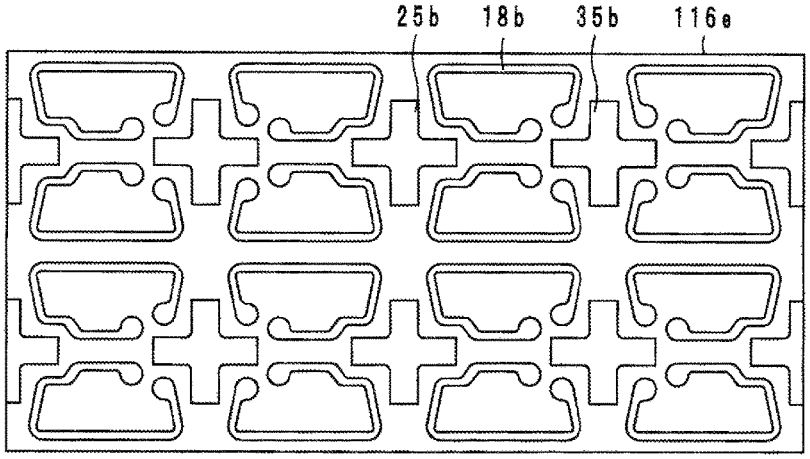

Next, as shown in FIG. 4B, the coil conductor layers 18*b*, the external conductive layers 25*b* and 35*b*, and the via hole conductors v1 are formed through a photolithography process. In particular, a photosensitive conductive paste containing Ag as a main metal is applied by screen printing so as to form a conductive paste layer on the insulating paste layer 116*e*, in the openings h1, and in the via holes H1. Furthermore, the conductive paste layer is exposed to ultraviolet rays or the like through a photo-mask and developed by using an alkaline solution or the like. As a result, the external conductive layers 25*b* and 35*b* are formed in the respective openings h1, the via hole conductors v1 are formed in the respective via holes H1, and the coil conductor layers 18*b* are formed on the insulating paste layer 116*e*.

Figure 5A:
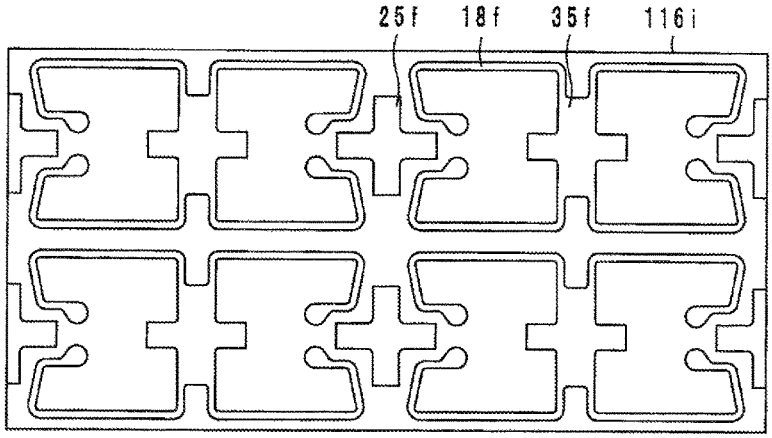
FIGS. 5A and 5B are plan views of the electronic component during production.

Following this, insulating paste layers 116*f* to 116*i*, the coil conductor layers 18*c* to 18*f*, the external conductive layers 25*c* to 25*f* and 35*c* to 35*f*, and the via hole conductors v2 to v6 are formed by repeating the process shown in FIGS. 4A and 4B. As a result, as shown in FIG. 5A, the coil conductor layers 18*f* and the external conductive layers 25*f* and 35*f* are formed on the insulating paste layer 116*i*.

Figure 5B:
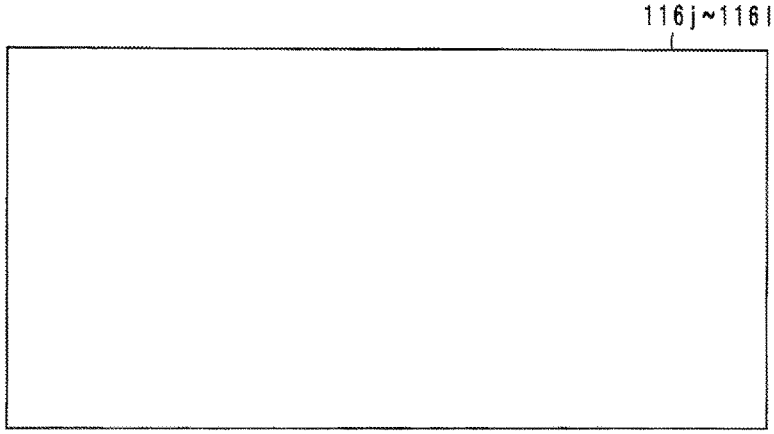

Next, as shown in FIG. 5B, insulating paste layers 116*j* to 116*l* are formed by repeating application of an insulating paste by screen printing. The insulating paste layers 116*j* to 116*l* are paste layers that will become the insulator layers 16*j* to 16*l*, which are insulator layers for external layers located outside of the coil L. A mother multilayer body 112 is obtained through the above processes.

Next, the mother multilayer body 112 is cut into a plurality of green multilayer bodies 12 by dicing or the like. In a cutting process of the mother multilayer body 112, the outer electrodes 14*a* and 14*b* will be exposed from the green multilayer bodies 12, on the corresponding cut surfaces that are formed by cutting.

Next, the green multilayer bodies 12 are baked under predetermined conditions so as to obtain the multilayer bodies 12. Furthermore, barrel polishing can be performed on the multilayer bodies 12.

Finally, portions of the outer electrodes 14*a* and 14*b* that are exposed from the multilayer bodies 12 can be plated, for example, tin-plated with a thickness in the range of 2 μm to 7 μm and nickel-plated with a thickness in the range of 2 μm to 7 μm. The electronic component 10 is completed through the above processes.

Figure 6:
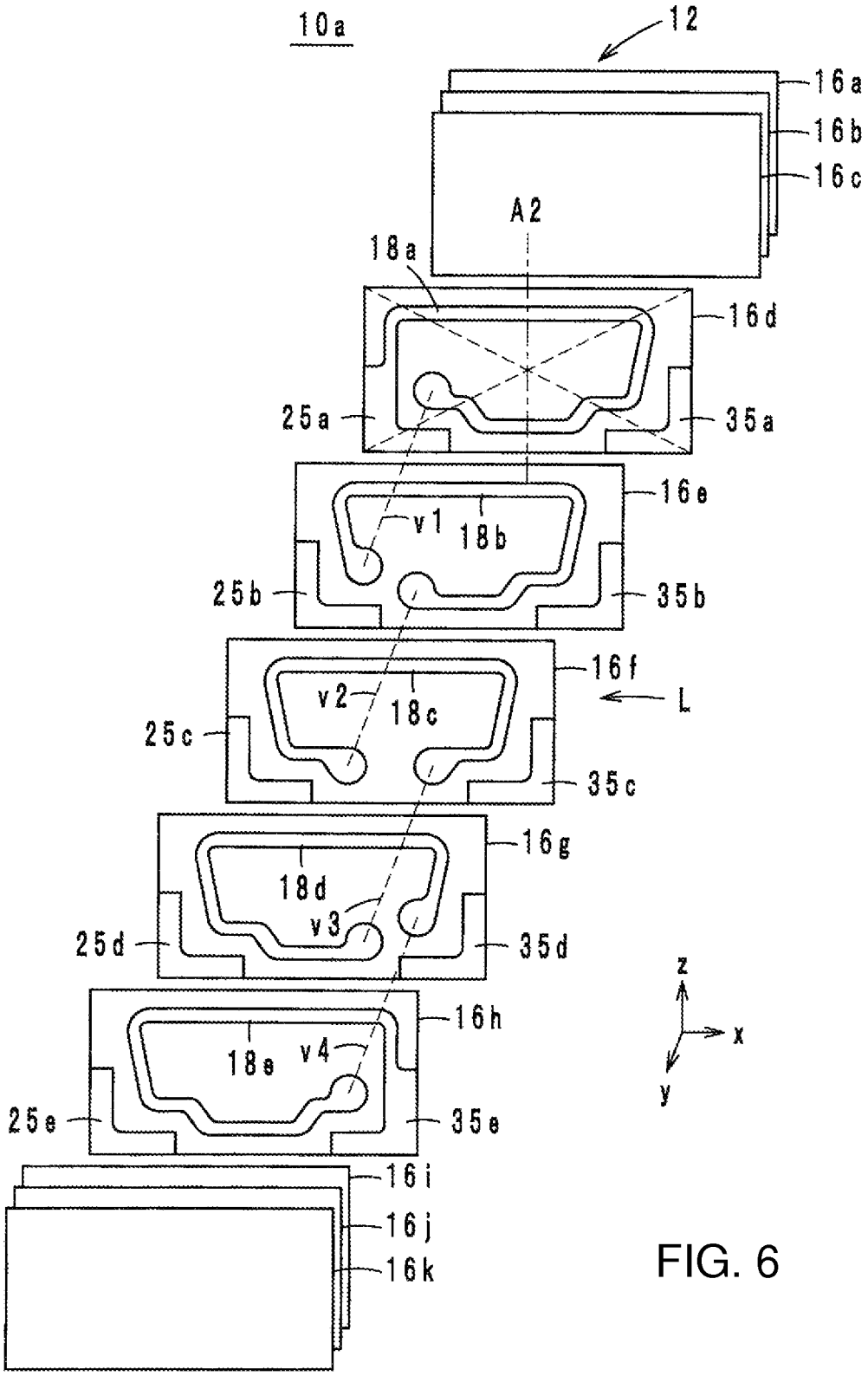
FIG. 6 is an exploded perspective view of an electronic component according to an exemplary modification.
Figure 7:
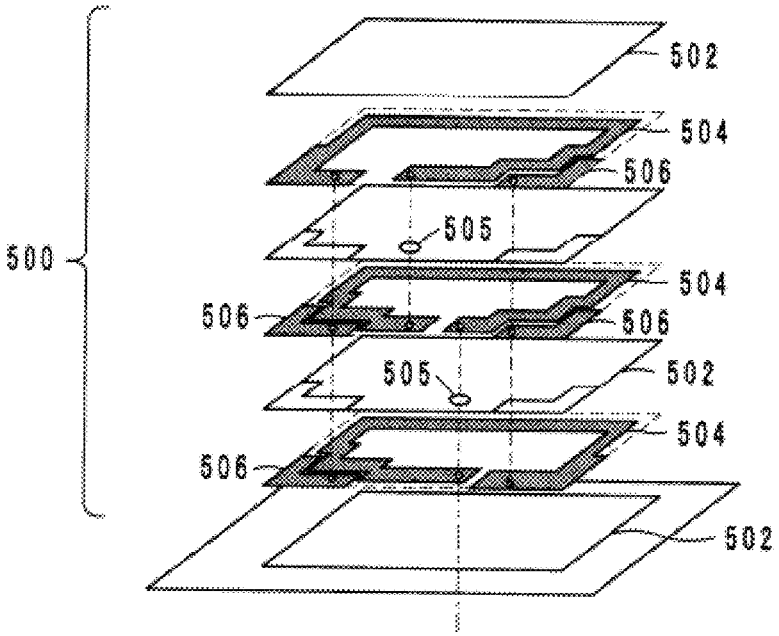
FIG.7 Prior Art
FIG. 7 is an exploded perspective view of a multilayer body of a multilayer inductor described in Patent Document 1.

An electronic component 10*a* according to an exemplary modification will now be described with reference to the accompanying drawing. FIG. 6 is an exploded perspective view of the electronic component 10*a* according to the exemplary modification.

A difference between the electronic component 10 and the electronic component 10*a* is the number of the coil conductor layers 18. More specifically, six coil conductor layers 18 (i.e., an even number of conductor layers) are provided in the electronic component 10, whereas five coil conductor layers 18 (i.e., an odd number of conductor layers) are provided in the electronic component 10*a*. The difference will be described in further detail below.

In the electronic component 10*a*, a coil conductor layer 18*a* that is a first layer and a coil conductor layer 18*e* that is a fifth layer are arranged so as to be line-symmetrical to each other with respect to a straight line A2. A coil conductor layer 18*b* that is a second layer and a coil conductor layer 18*d* that is a fourth layer are arranged so as to be line-symmetrical to each other with respect to the straight line A2.

Since the number of the coil conductor layers 18 is an odd number, there is no coil conductor layer 18 that corresponds to a coil conductor layer 18*c*. However, one of the coil conductor layers 18 that is a $k^{th}$ layer and one of the coil conductor layers 18 that is an $n-k+1^{th}$ layer are arranged so as to be line-symmetrical to each other with respect to the straight line A2. In the case where k=3 and n=5, the coil conductor layer 18*c* that is a third layer and the coil conductor layer 18*c* that is the third layer are arranged so as to be line-symmetrical to each other with respect to a straight line A2. That is, the coil conductor layer 18*c* has a line-symmetrical configuration with respect to a straight line A2.

As with the electronic component 10, the electronic component 10*a* having the above configuration is capable of having a large inner diameter of the coil L. In addition, as with the electronic component 10, the electronic component 10*a* can be mounted in the state shown in FIG. 1 and can also be mounted in a state where it is being rotated 180 degrees about the z axis from the state shown in FIG. 1. Furthermore, as with the electronic component 10, the electronic component 10*a* is capable of having a large number of turns of the coil L.

An electronic component according to the present disclosure is not limited to the electronic components 10 and 10*a* according to the above-described embodiment, and modifications can be made within the scope of the present disclosure.

Although six coil conductor layers 18 are provided in the electronic component 10, and five coil conductor layers 18 are provided in the electronic component 10*a*, the number of the coil conductor layers 18 of the electronic component 10 and 10*a* are not limited thereto.

Although the insulating paste layers 116 are formed through a photolithography process in the electronic components 10 and 10*a*, the insulating paste layers 116 may be formed by screen printing.

The path R may not avoid the outer electrodes 14*a* and 14*b* but may avoid via hole conductors or other conductive layers at the corners C3 and C6.

What is claimed is:

1. An electronic component comprising:

a multilayer body;

a coil that is a helical coil provided in the multilayer body, the coil including a plurality of coil conductor layers that are superposed with one another so as to form a ring-shaped path when seen in plan view from a stacking direction and a plurality of via hole conductors that connect the plurality of coil conductor layers together; and at least one conductor part provided in the multilayer body and provided outside of the ring-shaped path when seen in plan view from the stacking direction, wherein the ring-shaped path includes a plurality of first corners that project outward of the ring-shaped path and a plurality of second corners that project inward of the ring-shaped path, wherein all of the via hole conductors are provided at the respective first corners, wherein the ring-shaped path avoids contacting the at least one conductor part at the second corners, and wherein an outward extent of one coil conductor layer at one of the first corners at which one of the via hole conductors is connected is greater than an outward extent of another coil conductor layer at the same one corner.

2. The electronic component according to claim 1, wherein the multilayer body is formed by a plurality of insulator layers each having a rectangular shape stacked on top of one another, wherein at least one of the conductor parts is an outer electrode provided at a corner of at least one of the insulator layers, wherein the ring-shaped path has a substantially rectangular shape including four straight lines that extend along respective four sides of each insulator layer, and wherein one of the second corners is provided at a corner of the ring-shaped path that corresponds to the corner at which the outer electrode is provided in the at least one of the insulator layers.

3. The electronic component according to claim 1, wherein the ring-shaped path is divided into m sections by the plurality of via hole conductors, and wherein at least one of the coil conductor layers has a length of m−1 sections.

4. The electronic component according to claim 2, wherein the ring-shaped path is divided into m sections by the plurality of via hole conductors, and wherein at least one of the coil conductor layers has a length of m−1 sections.

5. The electronic component according to claim 1, wherein the ring-shaped path has an outer circumference and an inner circumference when seen in plan view from the stacking direction; and wherein at at least one of the plurality of first corners, the outer circumference of the ring-shaped path projects outward from a ring of the ring-shaped path when seen in plan view from the stacking direction.

6. The electronic component according to claim 1, wherein when viewed from a direction orthogonal to the stacking direction, the conductive part extends in the stacking direction so as to overlap the plurality of coil conductor layers, and each of the plurality of coil conductor layers has a second corner.

7. An electronic component comprising:

a multilayer body; and a coil that is a helical coil provided in the multilayer body, the coil including a plurality of coil conductor layers that are superposed with one another so as to form a ring-shaped path when seen in plan view from a stacking direction and a plurality of via hole conductors that connect the plurality of coil conductor layers together, wherein the ring-shaped path includes a plurality of first corners that project outward of the ring-shaped path and a second corner that projects inward of the ring-shaped path, wherein all of the via hole conductors are provided at the respective first corners, wherein the multilayer body is formed by a plurality of insulator layers each having a rectangular shape stacked on top of one another and is mounted via a mounting surface formed of outer edges of the plurality of insulator layers arranged in a row, and wherein the coil is identical to a coil that is obtained by rotating the coil 180 degrees about a straight line that passes a midpoint P of intersection points of an axis of the coil and two end surfaces of the multilayer body facing each other in the stacking direction and that is perpendicular to the mounting surface.

8. The electronic component according to claim 7, further comprising:

a conductor part provided in the multilayer body and provided outside of the ring-shaped path when seen in plan view from the stacking direction, wherein the ring-shaped path avoids contacting the conductor part at the second corner.

9. The electronic component according to claim 8, wherein the multilayer body is formed by a plurality of insulator layers each having a rectangular shape stacked on top of one another, wherein the conductor part is an outer electrode provided at a corner of at least one of the insulator layers, wherein the ring-shaped path has a substantially rectangular shape including four straight lines that extend along respective four sides of each insulator layer, and wherein the second corner is provided at a corner of the ring-shaped path that corresponds to the corner at which the outer electrode is provided in the at least one of the insulator layers.

10. The electronic component according to claim 7, wherein the ring-shaped path is divided into m sections by the plurality of via hole conductors, and wherein at least one of the coil conductor layers has a length of m−1 sections.

11. The electronic component according to claim 8, wherein the ring-shaped path is divided into m sections by the plurality of via hole conductors, and wherein at least one of the coil conductor layers has a length of m−1 sections.

12. The electronic component according to claim 9, wherein the ring-shaped path is divided into m sections by the plurality of via hole conductors, and wherein at least one of the coil conductor layers has a length of m−1 sections.

13. The electronic component according to claim 7, wherein the number of the coil conductor layers included in the coil is n, and wherein one of the coil conductor layers that is a $k^{th}$ layer and one of the coil conductor layers that is an $n-k+1^{th}$ layer are arranged so as to be line-symmetrical to each other with respect to a straight line that passes an intersection point of diagonal lines of each insulator layer and that is perpendicular to the mounting surface.

14. The electronic component according to claim 8, wherein the number of the coil conductor layers included in the coil is n, and wherein one of the coil conductor layers that is a $k^{th}$ layer and one of the coil conductor layers that is an $n-k+1^{th}$ layer are arranged so as to be line-symmetrical to each other with respect to a straight line that passes an intersection point of diagonal lines of each insulator layer and that is perpendicular to the mounting surface.

15. The electronic component according to claim 9, wherein the number of the coil conductor layers included in the coil is n, and wherein one of the coil conductor layers that is a $k^{th}$ layer and one of the coil conductor layers that is an $n-k+1^{th}$ layer are arranged so as to be line-symmetrical to each other with respect to a straight line that passes an intersection point of diagonal lines of each insulator layer and that is perpendicular to the mounting surface.

16. The electronic component according to claim 10, wherein the number of the coil conductor layers included in the coil is n, and wherein one of the coil conductor layers that is a $k^{th}$ layer and one of the coil conductor layers that is an $n-k+1^{th}$ layer are arranged so as to be line-symmetrical to each other with respect to a straight line that passes an intersection point of diagonal lines of each insulator layer and that is perpendicular to the mounting surface.

17. The electronic component according to claim 11, wherein the number of the coil conductor layers included in the coil is n, and wherein one of the coil conductor layers that is a $k^{th}$ layer and one of the coil conductor layers that is an $n-k+1^{th}$ layer are arranged so as to be line-symmetrical to each other with respect to a straight line that passes an intersection point of diagonal lines of each insulator layer and that is perpendicular to the mounting surface.

18. The electronic component according to claim 12, wherein the number of the coil conductor layers included in the coil is n, and wherein one of the coil conductor layers that is a $k^{th}$ layer and one of the coil conductor layers that is an $n-k+1^{th}$ layer are arranged so as to be line-symmetrical to each other with respect to a straight line that passes an intersection point of diagonal lines of each insulator layer and that is perpendicular to the mounting surface.

* * * * *